US007350495B2

(12) United States Patent
Harada

(10) Patent No.: US 7,350,495 B2
(45) Date of Patent: Apr. 1, 2008

(54) INTAKE SYSTEM OF INTERNAL COMBUSTION ENGINE AND METHOD OF CONTROLLING THE INTAKE SYSTEM

(75) Inventor: Toshikazu Harada, Toyota-shi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/643,857

(22) Filed: Dec. 22, 2006

(65) Prior Publication Data

US 2007/0163532 A1 Jul. 19, 2007

(30) Foreign Application Priority Data

Jan. 16, 2006 (JP) ..... 2006-007326

(51) Int. Cl.
*F02N 17/00* (2006.01)
*F02M 35/10* (2006.01)

(52) U.S. Cl. ..... 123/184.24; 123/179.1; 123/184.53

(58) Field of Classification Search ..... 123/179.1, 123/184.24, 184.53
See application file for complete search history.

(56) References Cited

FOREIGN PATENT DOCUMENTS

| | | |
|---|---|---|
| JP | 59-137368 U | 9/1984 |
| JP | 11-117819 A | 4/1999 |
| JP | 2003-172237 | 6/2003 |
| JP | 2005-188292 | 7/2005 |

*Primary Examiner*—Noah P. Kamen
(74) *Attorney, Agent, or Firm*—Kenyon & Kenyon LLP

(57) ABSTRACT

An intake system of an internal combustion engine includes a surge tank communicating with cylinders of the engine via individual intake paths, a vacuum tank connected to the surge tank, a valve that permits or inhibits communication between the surge tank and the vacuum tank, and a control unit that controls opening and closing of the valve. The control unit executes the steps of: (a) opening the valve to communicate the surge tank with the vacuum tank when the surge tank is held in a negative-pressure condition during operation of the engine, and closing the valve upon a lapse of a predetermined period of time so as to hold the vacuum tank in a negative-pressure condition, (b) opening the valve for a predetermined period of time when a condition for starting the engine is satisfied, so as to reduce the pressure in the surge tank, and (c) closing the valve when the engine is started.

8 Claims, 6 Drawing Sheets

INTAKE SYSTEM OF INTERNAL COMBUSTION ENGINE AND METHOD OF CONTROLLING THE INTAKE SYSTEM

The disclosure of Japanese Patent Application No. 2006-7326 filed on Jan. 16, 2006, including the specification, drawings and abstract, is incorporated herein by reference in its entirety.

BACKGROUND OF THE INVENTION

1. Field of the Invention

The invention relates to an intake system of an internal combustion engine, in which a surge tank is provided on the upstream side of individual intake paths that are connected to and communicate with respective cylinders of the engine. The invention also relates to a method of controlling the intake system.

2. Description of Related Art

In a conventional intake system of an internal combustion engine installed on a vehicle, such as an automobile, a surge tank is provided on the upstream side of individual intake paths that are connected to and communicate with respective cylinders of the engine, and an outside-air duct is connected to and communicates with the surge tank, while an air cleaner and a throttle body, for example, are provided in the outside-air duct, as disclosed in, for example, JP-A-H11-117819.

In the internal combustion engine of a type in which injectors are respectively mounted in the individual intake paths, for example, while the engine stops operating, air flows from the outside-air duct into the surge tank with the passage of time, so that the intake passages of the whole intake system are subjected to atmospheric pressure. Furthermore, a slight amount of fuel may drop or leak from injection nozzles of the injectors, and vapors of the fuel may exist in the individual intake paths. In this condition, the concentration of HC in the intake passages that extend from the individual intake paths to the outside-air duct is undesirably increased.

In the above-described situation, if backfire occurs upon start of the engine, the flame in the combustion chambers may propagate to the upstream portion of the intake system, thus causing reduction of the durability of respective components of the intake system.

In view of the above situation, it has been proposed in, for example, JP-U-S59-137368 to inhibit flame propagation to the air cleaner upon occurrence of backfire. In the known example, a normally-open type check valve is provided between the throttle body or a carburetor and the air cleaner in the air duct through which air is introduced into the engine. In operation, the check valve is closed when backfire occurs.

It has also been proposed in, for example, JP-A-2005-188292 to provide an internal combustion engine having a surge tank and a resonator in an intake system, in which flame propagation to the resonator is inhibited even if backfire occurs upon start of the engine. In the known example, an open/close valve is provided in a partition wall that separates the surge tank from the resonator. In operation, the open/close valve is closed when the engine is prepared to be started, and is opened when the engine is started.

It has also been proposed in, for example, JP-A-2003-172237 to provide an internal combustion engine provided with an intake manifold having a specified volume of space in an intake system, and to control the engine so as to suppress or prevent overshoot of the engine speed (i.e., a sudden rise in the rotational speed of the engine) when the engine is started. In the known example, a vacuum tank is connected to and communicates with the specified volume of space in the intake manifold, and an open/close valve (e.g., a solenoid-operated valve) is provided in a communicating portion between the intake manifold and the vacuum tank. In operation, the open/close valve is opened immediately before start of the engine, and is closed when starting of the engine is completed.

In the known example as disclosed in JP-U-S59-137368 identified above, the check valve is closed upon occurrence of backfire so as to inhibit flame propagation to the air cleaner. However, if a surge tank is located upstream of the individual intake paths and downstream of the throttle body as viewed in the direction of flow of the intake air, the flame may propagate into the surge tank.

In the known example as disclosed in JP-A-2005-188292 identified above, the open/close valve is closed upon detection of a request for start of the engine, so that flame propagation to the resonator can be inhibited even if backfire occurs upon start of the engine. With the open/close valve closed, however, the individual intake paths leading to the combustion chambers are held in communication with the surge tank; therefore, the flame may propagate into the surge tank if backfire occurs.

In the known example as disclosed in JP-A-2003-172237 identified above, overshoot of the engine speed at the time of start of the engine can be suppressed or prevented, but occurrence of backfire is not taken into consideration. In this example, when the engine is started, the open/close valve is opened so as to suppress or prevent overshoot of the engine speed, and the intake manifold and the vacuum tank are held in communication with each other. If backfire occurs in this condition, it is difficult or impossible to avoid flame propagation from the intake manifold to the upstream portion of the intake system including the vacuum tank.

Thus, there is some room for improvement in any of the known examples as described above.

SUMMARY OF THE INVENTION

It is an object of the invention to provide an intake system of an internal combustion engine having a surge tank, which system is arranged to suppress overshoot of the engine speed upon start of the engine so as to make a vehicle passenger or passengers feel less uncomfortable, and is also arranged to restrict or prevent flame propagation from individual intake paths into a surge tank even if backfire occurs, thus assuring improved durability of intake passages of the intake system. It is another object of the invention to provide a method of controlling the intake system as described above.

To accomplish the above and/or other object(s), there is provided according to one aspect of the invention an intake system of an internal combustion engine, which comprises: (a) a surge tank disposed on the upstream side of individual intake paths that are connected to and communicate with respective cylinders of the engine, (b) a vacuum tank that is connected to and communicates with the surge tank, the vacuum tank being formed integrally with or separately from the surge tank, (c) a valve that is selectively placed in a first position for communicating the vacuum tank with the surge tank and in a second position for inhibiting communication between the vacuum tank and the surge tank, and (d) a control unit that controls opening and closing operations of the valve. The control unit executes the steps of: (1) opening the valve to place the valve in the first position when the surge tank is held in a negative-pressure condition during operation of the engine, and closing the valve to place the valve in the second position after a predetermined period of time has elapsed so as to hold the vacuum tank in a negative-pressure condition, (2) opening the valve to place the valve in the first position for a predetermined period of time when a condition for starting the engine is satisfied, so as to reduce a pressure in the surge tank, and (c) closing the valve when the engine is started.

When the vacuum tank is formed separately (i.e., as a separate body) from the surge tank, and is connected to the surge tank via a communication passage, the valve may be provided in the communication passage. When the vacuum tank and the surge tank are formed integrally with each other, and a partition wall is provided between the vacuum tank and the surge tank, the valve may be provided in the partition wall.

In the intake system according to the above aspect of the invention, the pressure in the surge tank is reduced to a large negative pressure, for example, during idling of the engine, and air in the vacuum tank is drawn under suction into the surge tank and is thus supplied to the engine. If the operation of the engine is once stopped in this condition, the outside air is introduced little by little from an outside-air duct into the surge tank even though the surge tank is initially held in a negative-pressure condition, and the pressure in the surge tank becomes close to atmospheric pressure. When the engine is started in this condition, a large amount of air is prevented from being introduced from the surge tank and the individual intake paths into the combustion chambers as in conventional systems since the control unit of the intake system operates to open the valve for the predetermined period of time before start of the engine so as to reduce the pressure in the surge tank and the individual intake paths and evacuate the surge tank and the intake paths. Thus, overshoot of the engine speed (i.e., a sudden rise or increase of the engine speed to an excessively high level) is suppressed or prevented, and the vehicle passenger is prevented from feeling uncomfortable upon start of the engine.

Furthermore, even in a situation where air present in the individual intake paths and the surge tank is mixed with vapors of fuel that has dropped from injection nozzles of injectors during stop of the engine, namely, before start of the engine, and the fuel-containing air in the individual intake paths and the surge tank has an increased HC concentration, the control unit operates, prior to start of the engine, to open the valve so that the fuel-containing air in the surge tank and intake paths is drawn under suction into the vacuum tank, whereby the HC concentration in the surge tank is reduced to zero or a sufficiently low level. Thus, even if backfire occurs when the engine is started, the flame in the combustion chambers is unlikely to propagate into the individual intake paths and the surge tank.

Preferably, the control unit determines that the condition for starting the engine is satisfied when detecting generation of an ON signal from an ignition switch. If the condition for starting the engine is specified in this manner, the operation and effects of the invention are more clarified.

Preferably, the control unit determines that the engine is started when a starter switch is turned on. If the timing of start of the engine is specified in this manner, the operation and effects of the invention are more clarified. For example, since the pressure in the surge tank is reduced before start of the engine, air is less likely to flow from the surge tank into the combustion chambers of the engine when the starter switch is turned on to start the engine, and overshoot of the engine speed, which would otherwise occur immediately after start of the engine, can be suppressed or prevented.

Preferably, an engine ECU for controlling the internal combustion engine may be utilized to provide the control unit of the intake system according to the above aspect of the invention. In this case, there is no need to provide a control unit exclusively used for the intake system, and the cost of equipment can be advantageously reduced.

According to the invention, the intake system is arranged to suppress overshoot of the engine speed so as to make the vehicle passenger feel less uncomfortable when the engine is started, and is also arranged to restrict or prevent flame propagation from the individual intake paths into the surge tank even if backfire occurs, thus assuring improved durability of intake passages of the intake system.

BRIEF DESCRIPTION OF THE DRAWINGS

The foregoing and/or further objects, features and advantages of the invention will become more apparent from the following description of exemplary embodiments with reference to the accompanying drawings, in which like numerals are used to represent like elements and wherein.

DETAILED DESCRIPTION OF EXEMPLARY EMBODIMENTS

Some exemplary embodiments of the invention will be described in detail with reference to the drawings. FIG. 1 through FIG. 5 illustrate one exemplary embodiment of the invention. In this embodiment, an internal combustion engine 1 for which an intake system according to the invention is used is in the form of, for example, an in-line, four-cylinder gasoline engine installed on a vehicle, such as an automobile.

Figure 1:
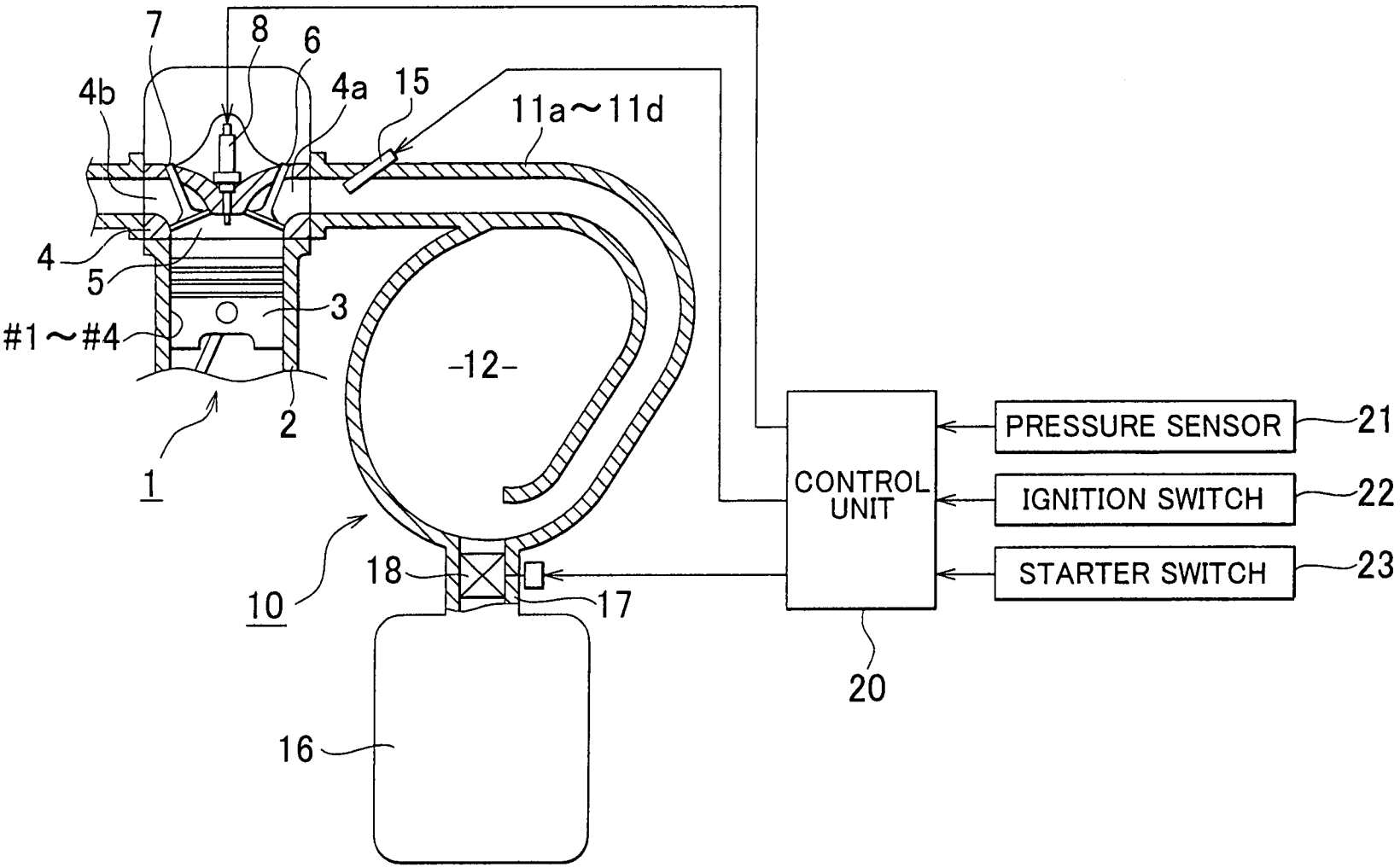
FIG. 1 is a view schematically showing an intake system of an internal combustion engine according to one embodiment of the invention.
Figure 2:
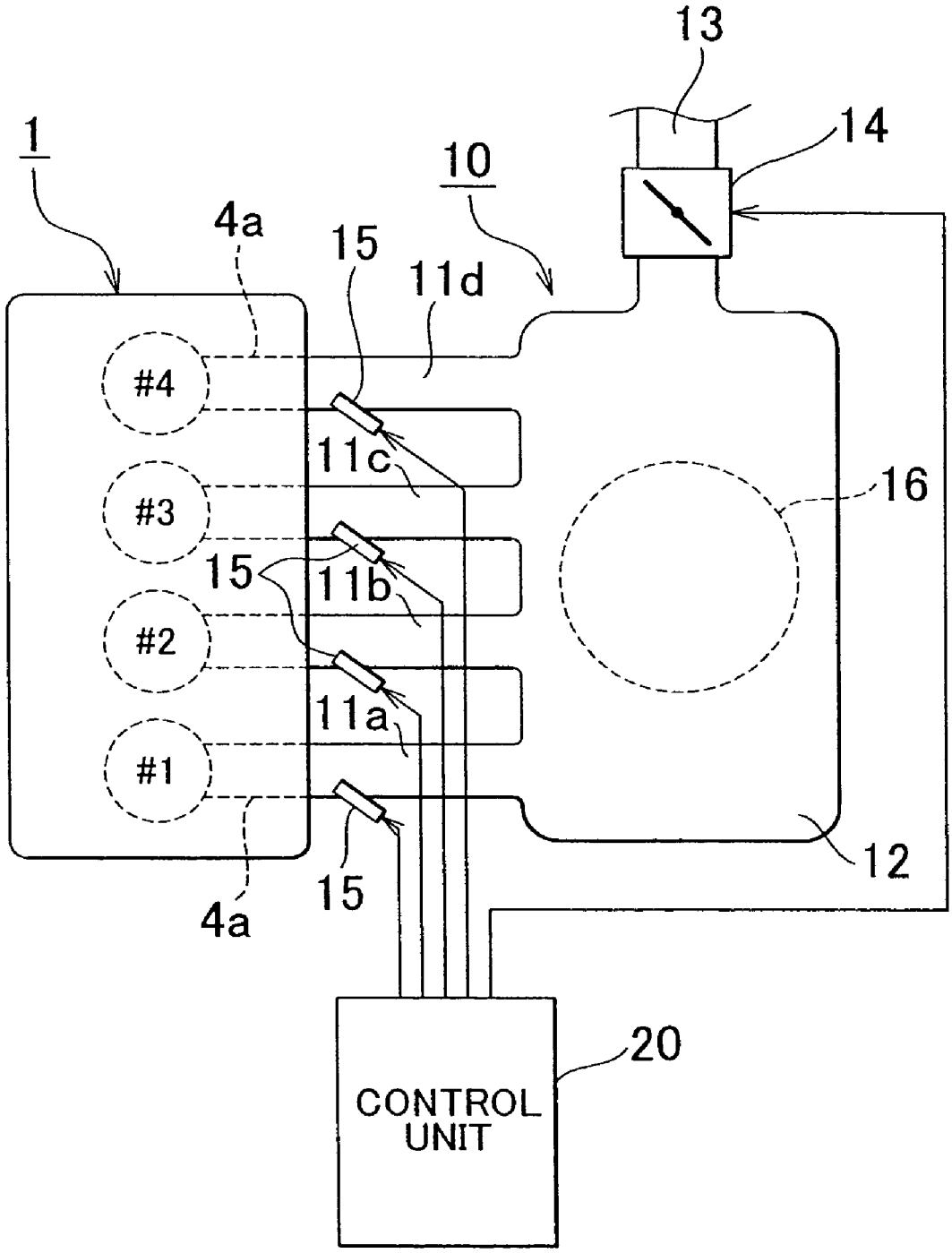
FIG. 2 is a view of the intake system of FIG. 1 as viewed in a plane perpendicular to the plane of FIG. 1.

As shown in FIG. 1 and FIG. 2, the engine 1 includes four cylinders #1-#4, which are formed in a cylinder block 2 and are arranged on a straight line. A piston 3 is inserted in each of the cylinders #1-#4 of the cylinder block 2 such that the piston 3 can reciprocate in the corresponding cylinder. In each of the cylinders #1-#4, a combustion chamber 5 is formed between the upper end of the piston 3 and a cylinder head 4.

In the cylinder head 4, an intake port 4*a* and an exhaust port 4*b* are provided for each of the combustion chambers 5. The openings of the intake port 4*a* and the exhaust port 4*b*, which are exposed to each combustion chamber 5, are adapted to be opened and closed by an intake valve 6 and an exhaust valve 7, respectively. An ignition plug 8 is also provided for each combustion chamber 5 in the cylinder head 4. An intake system 10 is attached to each of the intake ports 4*a*, and an exhaust manifold (not shown) is attached to each of the exhaust ports 4*b*.

In the following, the construction of the intake system 10 according to this embodiment of the invention will be described in detail.

In the intake system 10, four individual intake paths 11*a*-11*d* are connected to and communicate with the respective intake ports 4*a* of the cylinder head 4, and a single surge tank 12 is connected to and communicates with the upstream ends of the individual intake paths 11*a*-11*d*. The individual intake paths 11*a*-11*d* are formed in a single block or unit that provides what is called "intake manifold". Injectors 15 for injecting fuel are respectively mounted in the individual intake paths 11*a*-11*d*.

An outside-air duct 13 is connected to and communicates with the single surge tank 12. A throttle body 14 adapted to be opened and closed based on the operation of the accelerator pedal (not shown) is mounted in a downstream portion of the outside-air duct 13 as viewed in the air intake direction in which air is drawn into the intake system 10. An air cleaner (not shown) is mounted in the outside-air duct 13 at a location upstream of the throttle body 14 as viewed in the air intake direction.

A vacuum tank 16 formed separately from or independently of the surge tank 12 is connected to and communicates with the surge tank 12 via a communication pipe 17, as shown in FIG. 1. A valve 18, which is provided in the communication pipe 17, is selectively placed in a first position for communicating the surge tank 12 with the vacuum tank 16 and in a second position for inhibiting communication between the surge tank 12 and the vacuum tank 16. The surge tank 12 and the vacuum tank 16 are brought into a non-communicating condition when the valve 18 is closed, and are brought into a communicating condition when the valve 18 is opened.

More specifically, the vacuum tank 16 has substantially the same volume as the surge tank 12. The valve 18 includes a valve body of butterfly type, for example, which may be directly opened and closed by use of the air pressure or a suitable actuator, such as an electric motor, or may be indirectly opened and closed via a wire, or the like. A control unit 20 is provided for suitably controlling the opening and closing operations of the valve 18.

For example, an engine ECU that controls general operations of the engine 1 also serves as the control unit 20. The control unit 20 is arranged to carry out processes concerning countermeasures against overshoot and backfire during starting of the engine 1.

More specifically, the control unit 20 is arranged to receive output signals from at least a pressure sensor 21, an ignition switch 22 and a starter switch 23, as shown in FIG. 1. In operation, the control unit 20 controls the opening and closing operations of the valve 18 based on the output signals from the pressure sensor 21, ignition switch 22 and the starter switch 23, according to, for example, the flowchart shown in FIG. 3, thereby to carry out processes relating to countermeasures against overshoot and backfire during starting of the engine 1.

The above-indicated pressure sensor 21 measures the pressure in the surge tank 12. The ignition switch 22 and the starter switch 23 are turned ON or OFF in turn as the vehicle operator performs a two-step turning operation on an ignition key (not shown), as generally known in the art.

The processes or operations performed by the control unit 20 will be more specifically described.

During operation of the engine 1, air that is taken in through the outside-air duct 13 in accordance with the opening of the throttle body 14 is passed through the air cleaner (not shown), and is then drawn into the surge tank 12. The air drawn into the surge tank 12 is mixed with fuel injected from the injectors 15 in the individual intake paths 11*a*-11*d*, and is then fed to the respective combustion chambers 5 of the engine 1 so that the air-fuel mixture is burned in the chambers 5.

If the engine 1 stops operating, the outside air passes through the outside-air duct 13 and a slight clearance of the throttle body 14 with the passage of time, and flows into the individual intake paths 11*a*-11*d* so that the intake passages of the whole intake system are subjected to atmospheric pressure. In this condition, if slight amounts of fuel are dropped from injection nozzles of the injectors 15, for example, and fuel vapors exist in the individual intake paths 11*a*-11*d*, the concentration of HC in the intake passages extending from the individual intake paths 11*a*-11*d* to the outside-air duct 13 is increased.

If the engine 1 is started under this situation, a sudden increase, or overshoot, of the engine speed takes place, which makes the vehicle passenger(s) feel uncomfortable. In addition, if backfire occurs, the flame in the combustion chambers 5 is likely to fire fuel-containing air that is present in the individual intake paths 11*a*-11*d* and the surge tank 12, and the flame may propagate to the upstream portion of the intake system, causing reduction of the durability of the whole intake system or intake passages.

The intake system 10 according to this embodiment is arranged to suppress or prevent overshoot of the engine speed as described above, and inhibit flame propagation into the surge tank 12 even if backfire occurs, as will be described in detail below.

During an idling operation of the engine 1, for example, in which the vehicle speed is zero (i.e., the vehicle is being stopped) and the negative pressure in the surge tank 12 is large (in this case, an affirmative decision (YES) is obtained in step S1), the valve 18 is opened so as to communicate the surge tank 12 with the vacuum tank 16, and the internal timer of the control unit 20 is started in step S2. As a result, gas in the vacuum tank 16 is drawn under suction into the surge tank 12 so that negative pressure builds up in the vacuum tank 16. Namely, the interior of the vacuum tank 16 is brought into a negative-pressure condition. After a predetermined period of time has elapsed in this condition (if an affirmative decision (YES) is obtained in step S3), the valve 18 is closed in step S4 so as to hold the vacuum tank 16 in a negative-pressure condition.

In step S5, it is determined whether the operation of the engine 1 is once stopped. Although the outside air is gradually introduced from the outside-air duct 13 into the surge tank 12 while the operation of the engine 1 is being stopped, the pressure in the vacuum tank 16 is kept unchanged (in other words, the negative pressure in the vacuum tank 16 is maintained) since the valve 18 is held in the closed state.

If the ignition switch 22 is turned on to establish an engine starting condition upon re-start of the engine 1 (if an affirmative decision (YES) is obtained in step S6), the valve 18 is opened, and the internal timer of the control unit 20 is started in step S7. As a result, the air in the surge tank 12 and the individual intake paths 11*a*-11*d* is drawn under suction into the vacuum tank 16 under the negative pressure of the vacuum tank 16, and the pressure in the surge tank 12 is reduced.

After a predetermined period of time has elapsed from execution of step S7 (if an affirmative decision (YES) is obtained in step S8), the valve 18 is closed in step S9 so that the surge tank 12 is disconnected from the vacuum tank 16, namely, the communication between the surge tank 12 and the vacuum tank 16 is cut off.

Until the conclusion of the predetermined elapsed time (if a negative decision (NO) is obtained in step S8), the control unit 20 checks if the starter switch 23 is turned on. If the starter switch 23 is turned on (if an affirmative decision (YES) is obtained in step S10), the valve 18 is closed in step S11 so that the surge tank 12 is disconnected from the vacuum tank 16, namely, the communication between the surge tank 12 and the vacuum tank 16 is cut off. At substantially the same time, a starter motor (not shown) is driven so as to start the engine 1.

When the engine 1 is started, the surge tank 12 and the individual intake paths 11*a*-11*d* are held in negative-pressure conditions, and substantially no air is present in the surge tank 12 and intake paths 11*a*-11*d*. Therefore, a large amount of air is prevented from being introduced from the surge tank 12 and the individual intake paths 11*a*-11*d* into the combustion chambers 5 as in a conventional intake system, and overshoot of the rotational speed of the engine 1 is suppressed or prevented.

Figure 4:
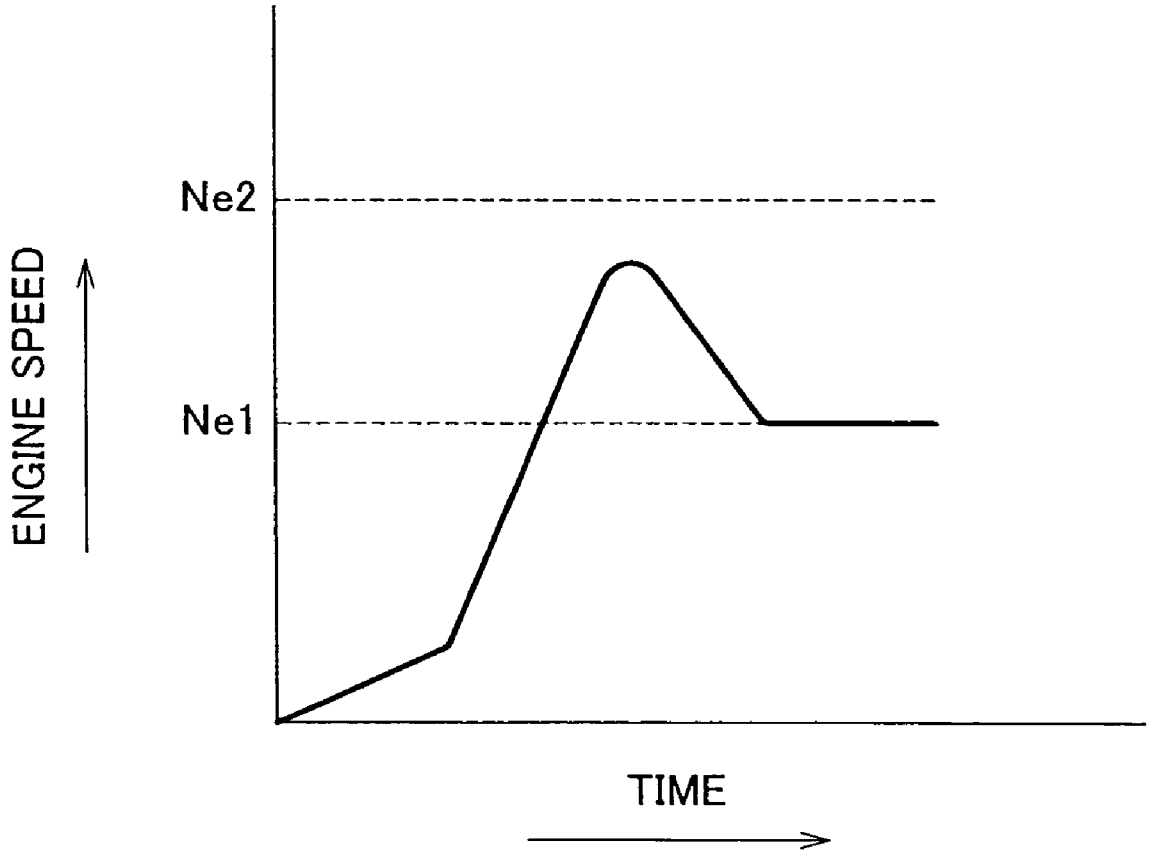
FIG. 4 is a graph indicating an example of overshoot that occurs upon start of the engine.

Referring to FIG. 4, for example, if the engine speed exceeds a suitably set speed Ne2 that is higher by some degree than the idling speed Ne1, the overshoot of the engine speed undesirably causes the vehicle passenger to feel rather uncomfortable. If the engine speed is kept equal to or lower than the set speed Ne2, however, the overshoot is considered as being in a permissible or acceptable range. Thus, the intake system of this embodiment controls the engine speed to be equal to or lower than the set speed Ne2, thereby to suppress overshoot and prevent the vehicle passenger from feeling uncomfortable.

Figure 3:
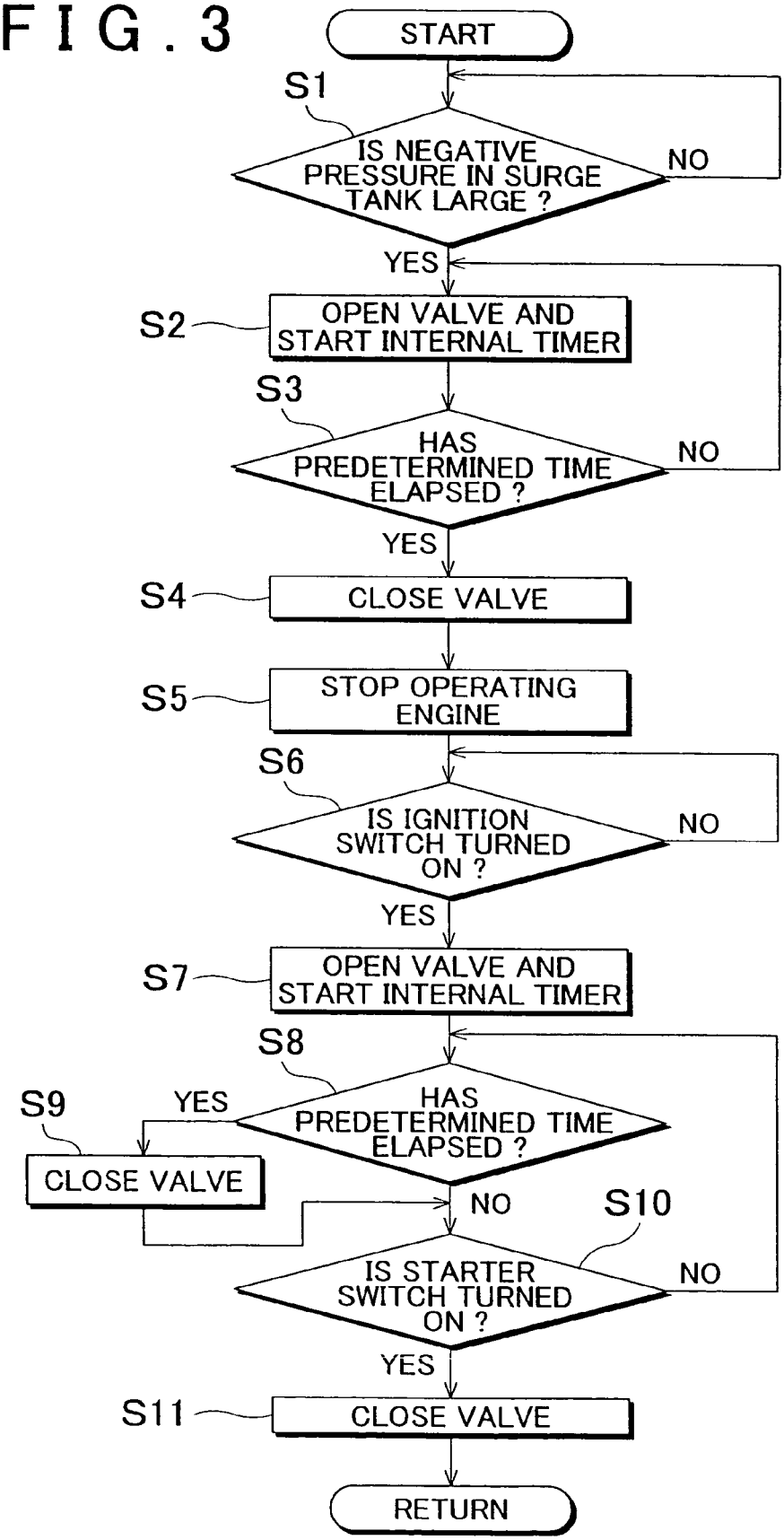
FIG. 3 is a flowchart used for explaining the operation of the internal combustion engine controlled by a control unit of the intake system of FIG. 1.

Furthermore, even if air that exists in the individual intake paths 11*a*-11*d* and surge tank 12 is mixed with vapors of fuel that drops from the injection nozzles of the injectors 5, for example, and has an increased HC concentration, prior to start of the engine 1, the fuel-containing air in the surge tank 12 and intake paths 11*a*-11*d* is drawn under suction into the vacuum tank 16 through the pre-start process of steps S6-S8 of FIG. 3 as described above, so that the HC concentration in the surge tank 12 is made equal to or close to zero. Therefore, even in the case where backfire occurs upon start of the engine 1, the flame, shock and pressure in the combustion chambers 5 are inhibited from propagating into or being transmitted to the individual intake paths 11*a*-11*d* and surge tank 12.

In this connection, it is possible to control the limit of overshoot of the engine speed and the degree of suppression of secondary adverse effects of backfire as desired by suitably specifying the proportion of the total volume of the surge tank 12 and individual intake paths 11*a*-11*d* and the volume of the vacuum tank 16, the length of time for which the valve 18 is opened, and so forth.

As explained above, the intake system 10 according to this embodiment of the invention is able to effectively suppress or avoid overshoot of the engine speed and secondary adverse effects of backfire, which would otherwise appear upon start of the engine 1.

Other embodiments of the invention will be described below.

Figure 5:
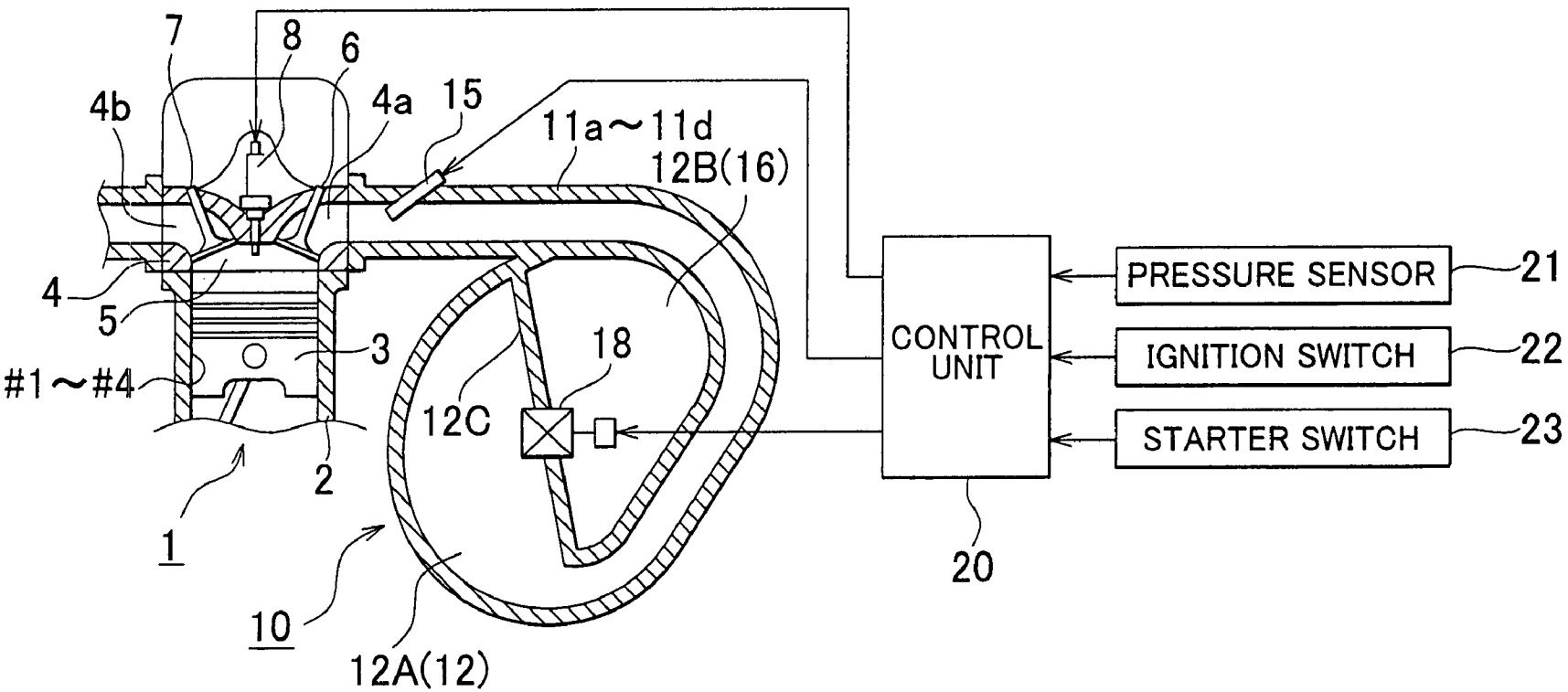
FIG. 5 is a view corresponding to that of FIG. 1, which shows an intake system of an internal combustion engine according to another embodiment of the invention.

(1) While the vacuum tank 16 is formed separately from or independently of the surge tank 12 in the illustrated embodiment, the vacuum tank 16 and the surge tank 12 may be formed as an integral body. In a modified embodiment as shown in FIG. 5 by way of example, the surge tank 12 is formed in a substantially cylindrical shape, and the interior of the surge tank 12 is divided by a partition wall 12C that extends in the axial direction into semi-cylindrical chambers 12A, 12B. Of these chambers 12A, 12B, the chamber 12A formed on the side communicating with the individual intake paths 11*a*-11*d* serves as a surge tank 12, and the other chamber 12B serves as a vacuum tank 16. The valve 18 is provided in the partition wall 12C. With this arrangement, the opening and closing operations of the valve 18 are controlled in the same manner as in the illustrated embodiment, and the intake system of this embodiment provides substantially the same effects as those of the illustrated embodiment.

Figure 6:
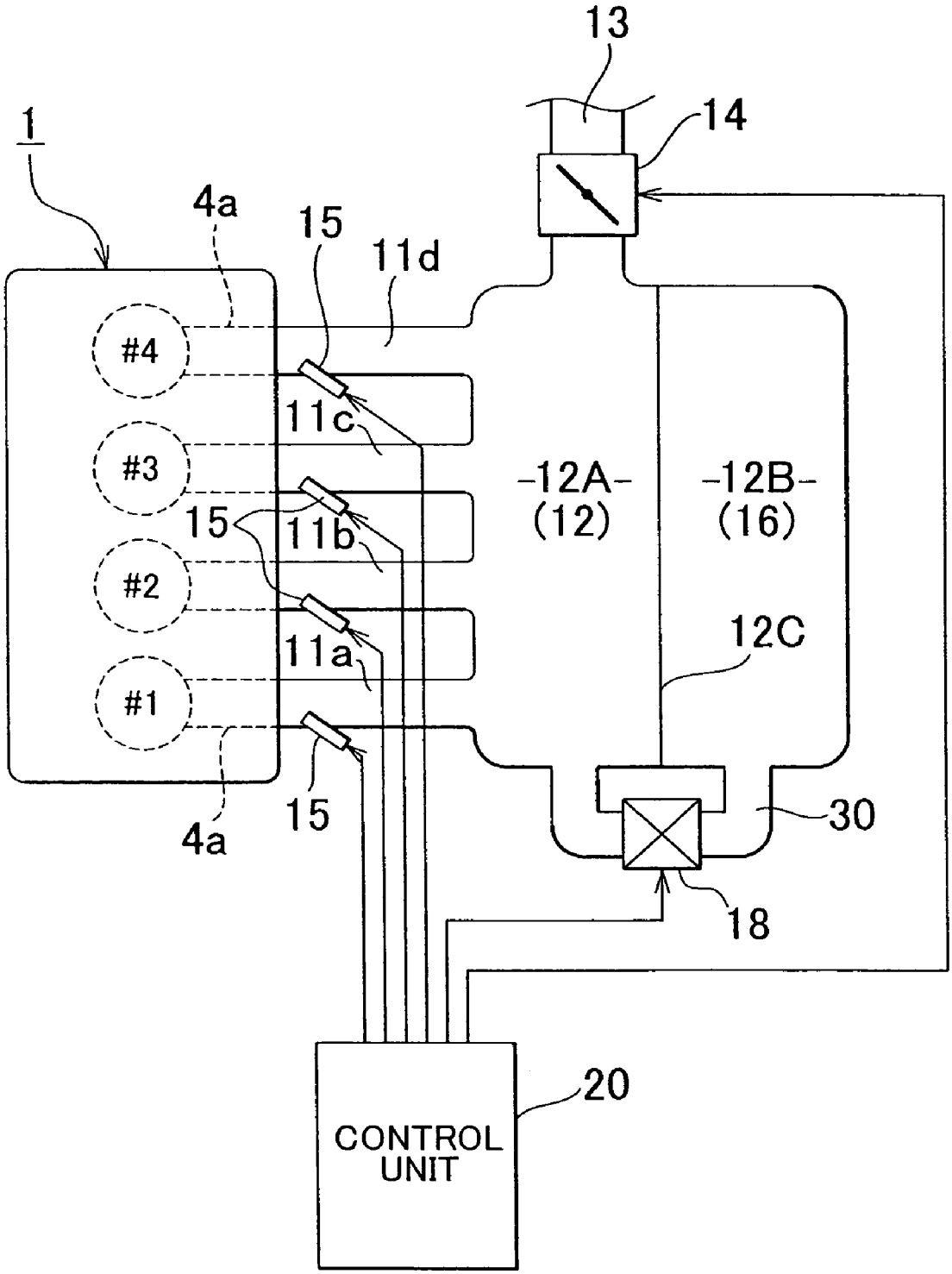
FIG. 6 is a view corresponding to that of FIG. 2, which shows an intake system of an internal combustion engine according to a further embodiment of the invention.

(2) According to another embodiment in which the vacuum tank 16 and the surge tank 12 are formed as an integral body as in the embodiment (1) as described just above, the intake system is constructed as shown in, for example, FIG. 6. In FIG. 6, the surge tank 12 is formed in a substantially cylindrical shape, and the interior of the surge tank 12 is divided by a partition wall 12C that extends in the axial direction into semi-cylindrical chambers 12A, 12B. Of these chambers 12A, 12B, the chamber 12A formed on the side communicating with or connected to the individual intake paths 11*a*-11*d* serves as a surge tank 12, and the other chamber 12B serves as a vacuum tank 16. These chambers 12A, 12B are connected to and communicate with each other via a communication pipe 30 that is disposed outside of the chambers 12A, 12B, and the valve 18 is provided in the communication pipe 30. With this arrangement, too, the opening and closing operations of the valve 18 are controlled in the same manner as in the illustrated embodiment, and the intake system of this embodiment provides substantially the same effects as those of the illustrated embodiment.

(3) The invention may be applied to the case where so-called idling stop is performed, namely, where the engine is stopped during idling and is automatically restarted when a certain condition or conditions is/are satisfied. In this case, the vacuum tank 16 is brought into a negative-pressure condition during operation of the engine 1, and, when the condition(s) for restarting the engine 1 is/are satisfied after the engine 1 is stopped during idling, the valve 18 is opened so as to communicate the surge tank 12 with the vacuum tank 16 and brings the surge tank 12 into a negative-pressure condition. Then, the process of step S11 as shown in FIG. 3, namely, the operation to close the valve 18 and disconnect the surge tank 12 from the vacuum tank 16, is performed in response to a drive signal generated from the control unit 20 (e.g., engine ECU) to a starter motor (not shown).

In the above case, too, overshoot of the rotational speed of the engine 1 can be suppressed or prevented when the engine 1 is restarted after being stopped during idling. Even if backfire occurs upon restart of the engine 1, the flame, shock and pressure in the combustion chambers 5 are prevented from propagating into or being transmitted to the surge tank 12.

The above-indicated condition(s) for restarting the engine 1 may include those known in the art. For example, the restarting conditions may be satisfied when the vehicle operator releases the brake pedal (not shown) that has been depressed, or when the vehicle operator depresses the accelerator pedal (not shown) that has been released.

What is claimed is:

1. An intake system of an internal combustion engine, comprising:

a surge tank disposed on the upstream side of individual intake paths that are connected to and communicate with respective cylinders of the engine;

a vacuum tank that is connected to and communicates with the surge tank, the vacuum tank being formed integrally with or separately from the surge tank;

a valve that is selectively placed in a first position for communicating the vacuum tank with the surge tank and in a second position for inhibiting communication between the vacuum tank and the surge tank; and a control unit that controls opening and closing operations of the valve, wherein the control unit executes the steps of:

opening the valve to place the valve in the first position when the surge tank is held in a negative-pressure condition during operation of the engine, and closing the valve to place the valve in the second position after a predetermined period of time has elapsed so as to hold the vacuum tank in a negative-pressure condition;

opening the valve to place the valve in the first position for a predetermined period of time when a condition for starting the engine is satisfied, so as to reduce a pressure in the surge tank; and closing the valve when the engine is started.

2. The intake system as defined in claim 1, wherein the control unit determines that the condition for starting the engine is satisfied when detecting generation of an ON signal from an ignition switch.

3. The intake system as defined in claim 2, wherein the control unit determines that the engine is started when a starter switch is turned on.

4. The intake system as defined in claim 1, wherein the control unit determines that the engine is started when a starter switch is turned on.

5. A method of controlling an intake system of an internal combustion engine, the intake system including: (a) a surge tank disposed on the upstream side of individual intake paths that are connected to and communicate with respective cylinders of the engine, (b) a vacuum tank that is connected to and communicates with the surge tank, and (c) a valve that is selectively placed in a first position for communicating the vacuum tank with the surge tank and in a second position for inhibiting communication between the vacuum tank and the surge tank, comprising the steps of:

opening the valve to place the valve in the first position when the surge tank is held in a negative-pressure condition during operation of the engine, and closing the valve to place the valve in the second position after a predetermined period of time has elapsed so as to hold the vacuum tank in a negative-pressure condition;

opening the valve to place the valve in the first position for a predetermined period of time when a condition for starting the engine is satisfied, so as to reduce a pressure in the surge tank; and closing the valve when the engine is started.

6. The method as defined in claim 5, wherein it is determined that the condition for starting the engine is satisfied when an ON signal is generated from an ignition switch.

7. The method as defined in claim 6, wherein it is determined that the engine is started when a starter switch is turned on.

8. The method as defined in claim 5, wherein it is determined that the engine is started when a starter switch is turned on.

* * * * *